US010136787B2

(12) United States Patent
Wang

(10) Patent No.: US 10,136,787 B2
(45) Date of Patent: Nov. 27, 2018

(54) IMAGE PROCESSING METHOD AND IMAGE PROCESSING APPARATUS WHICH CAN PERFORM BACKGROUND NOISE REMOVING BASED ON COMBINED IMAGE

(71) Applicant: PixArt Imaging Inc., Hsin-Chu (TW)

(72) Inventor: Guo-Zhen Wang, Hsin-Chu (TW)

(73) Assignee: PixArt Imaging Inc., Hsin-Chu (TW)

( * ) Notice: Subject to any disclaimer, the term of this patent is extended or adjusted under 35 U.S.C. 154(b) by 33 days.

(21) Appl. No.: 14/989,807

(22) Filed: Jan. 7, 2016

(65) Prior Publication Data

US 2016/0353036 A1 Dec. 1, 2016

(30) Foreign Application Priority Data

May 26, 2015 (TW) ..... 104116733 A

(51) Int. Cl.
*H04N 5/217* (2011.01)
*A47L 11/24* (2006.01)

(52) U.S. Cl.
CPC ..... *A47L 11/24* (2013.01); *A47L 2201/04* (2013.01)

(58) Field of Classification Search
CPC ..... H04N 5/357
USPC ..... 348/241
See application file for complete search history.

(56) References Cited

U.S. PATENT DOCUMENTS

| | | | | |
|---|---|---|---|---|
| 7,619,664 | B2 | 11/2009 | Pollard | |
| 9,270,899 | B1 * | 2/2016 | Ivanchenko | G06T 7/11 |
| 2007/0014550 | A1 * | 1/2007 | Dote | G03B 15/00 396/1 |
| 2009/0284613 | A1 * | 11/2009 | Kim | G06T 5/50 348/222.1 |
| 2010/0053349 | A1 * | 3/2010 | Watanabe | H04N 5/23232 348/222.1 |
| 2012/0188394 | A1 * | 7/2012 | Park | H04N 5/23212 348/222.1 |
| 2013/0182077 | A1 | 7/2013 | Holz | |

FOREIGN PATENT DOCUMENTS

| | | |
|---|---|---|
| TW | 200816784 | 4/2008 |
| TW | 201005675 | 2/2010 |

* cited by examiner

*Primary Examiner* — Usman A Khan
(74) *Attorney, Agent, or Firm* — Winston Hsu

(57) ABSTRACT

An image processing method, applied to an image processing apparatus comprising a light source and an image sensor. The image sensing method comprises: acquiring a first image via the image sensor if the light source operates in a first mode; acquiring a second image via the image sensor if the light source operates in a second mode; acquiring a third image via the image sensor if the light source operates in the first mode; generating a combined image based on the first image and the third image; and acquiring a target image after background noise removing based on the second image and the combined image.

16 Claims, 10 Drawing Sheets

IMAGE PROCESSING METHOD AND IMAGE PROCESSING APPARATUS WHICH CAN PERFORM BACKGROUND NOISE REMOVING BASED ON COMBINED IMAGE

BACKGROUND OF THE INVENTION

1. Field of the Invention

The present invention relates to an image processing method and an image processing apparatus, and particularly relates to an image processing method and an image processing apparatus which can acquire a target image after background noise removing.

2. Description of the Prior Art

In recent years, an auto clean apparatus (ex. a clean robot) becomes more and more popular. Via using theses auto clean apparatus, the clean activities can be performed even the user is not there. Such apparatus can be charged by a charging base when it does not perform a clean operation. Also, the auto clean apparatus will leave the charging base to perform a clean operation if it senses nearby environment is dirty, or to perform a clean operation at a predetermined timing. The auto clean apparatus goes back to the charging base if the clean operation is accomplished. Therefore, the auto clean apparatus must have a function of distance measuring, to measure a distance between the auto clean apparatus and nearby objects (ex. a wall, a chair). If the auto clean apparatus does not have a function of distance measuring, the auto clean apparatus may knock against the object, such that the auto clean apparatus or the object may be damaged.

The auto clean apparatus always comprises a distance measuring apparatus to measure the distance, which can apply a plurality of mechanisms to measure the distance. One of the mechanisms is measuring the distance based on images. For such mechanism, the distance measuring apparatus comprises an image sensor to acquire a plurality of images of a target object (ex. wall), and then computes a distance according to these images. For example, the distance is computed according to a distance, an angle or deformation for the image object in the images.

However, the captured images may be disturbed by nearby environment (ex. environment light), such that error may occurs while computing a distance. In order to solve such problem, a step of "background noise removing" can be performed to the captured image to calibrate the captured image, and then the distance is computed according to the calibrated image. Normally, a light source is applied to emit light to a target object and then an image A is captured, then an image B is captured without emitting light, and then a target image after background noise removing is acquired via subtracting the B image from the A image. After that, the target image after background noise removing is applied for the computing of the distance. However, some problems may occur while such background noise removing step is performed while the auto clean apparatus is moving and the frame rate is high.

FIG. 1A is a schematic diagram illustrating that an auto clean apparatus gradually moves away from a target object W. In the example of FIG. 1A, the auto clean apparatus R gradually moves away from the target object W (ex. a wall). Therefore, as illustrated in FIG. 1A, ranges for the captured images are different. The captured images are respectively f1, f2 and f3 while the auto clean apparatus R is at the locations P1, P2 and P3. Also, the light source turns on if the auto clean apparatus R is at the locations P1, P3, and the light source turns off if the auto clean apparatus R is at the locations P2. Therefore, the target image after background noise removing can be acquired via subtracting the image f2 from the image f3. However, ranges for the captured images when the auto clean apparatus R is at the locations P2 and P3 are different, thus the image f2 contains information fewer than which of the image f3 (indicated by the region marked by slant lines in FIG. 1B). Also, the sizes for image objects Ob1, Ob2 may be different, thus a wrong target image may be acquired while removing background information.

Similar problems may occur when the auto clean apparatus R moves relative to the target object W (in parallel or with an angle) or rotates. FIG. 2A is a schematic diagram illustrating a conventional auto clean apparatus moves relative to the target object W, and FIG. 2B is a schematic diagram illustrating how to acquire a target image after background noise removing in the example depicted in FIG. 2A. As illustrated in FIG. 2B, the auto clean apparatus R moves relative to the target object W and respectively captures images f1, f2, f3 for locations P1, P2, P3. The light source provided therein turns on if the auto clean apparatus R is at the locations P1, P3, and the light source turns off if the auto clean apparatus R is at the locations P2. Accordingly, a subtracting step is performed to images f2, f3 to acquire the target image after background noise removing. However, the images f2, f3 contains different content. As illustrated in FIG. 2B, the image f2 contains objects ob1, ob2, but the image f3 only contains the object ob2. Accordingly, if a subtracting step is performed to images f2 and f3 to acquire the target image after background noise removing, a wrong target image may be acquired and a wrong distance is acquired. The situations in FIGS. 2A and 2B may occur while the auto clean apparatus R rotates.

In view of above-mentioned description, a wrong target image may be acquired thus a wrong distance is acquired due to movement of the auto clean apparatus, if a conventional background noise removing step is applied. Such problem becomes more serious if the auto clean apparatus moves with a high speed or a high frame rate (i.e. an image capture frequency).

SUMMARY OF THE INVENTION

Therefore, one objective of the present invention is to provide an image processing method that can acquire a correct target image after background noise removing.

Another objective of the present invention is to provide an image processing apparatus that can acquire a correct target image after background noise removing.

One embodiment of the present invention discloses an image processing method, applied to an image processing apparatus comprising a light source and an image sensor. The image sensing method comprises: acquiring a first image via the image sensor if the light source operates in a first mode; acquiring a second image via the image sensor if the light source operates in a second mode; acquiring a third image via the image sensor if the light source operates in the first mode; generating a combined image based on the first image and the third image; and acquiring a target image after background noise removing based on the second image and the combined image.

Another embodiment of the present invention discloses an image processing apparatus, which comprises: a light source; an image sensor, configured to acquire a first image if the light source operates in a first mode, to acquire a second image if the light source operates in a second modem and to acquire a third image if the light source operates in the first mode; and an image computing unit, configured to generate a combined image based on the first image and the third image, and to acquire a target image after background noise removing based on the second image and the combined image.

In view of above-mentioned embodiments, the image processing method provided by the present invention can avoid the problem that a wrong target image after background noise removing is acquired due to the movement of the auto clean apparatus, thereby a correct distance can be computed.

These and other objectives of the present invention will no doubt become obvious to those of ordinary skill in the art after reading the following detailed description of the preferred embodiment that is illustrated in the various figures and drawings.

DETAILED DESCRIPTION

Different embodiments are provided to explain the concept of the present invention. It will be appreciated that the following embodiments are only examples for explaining and do not mean to limit the scope of the present invention.

Figure 3:
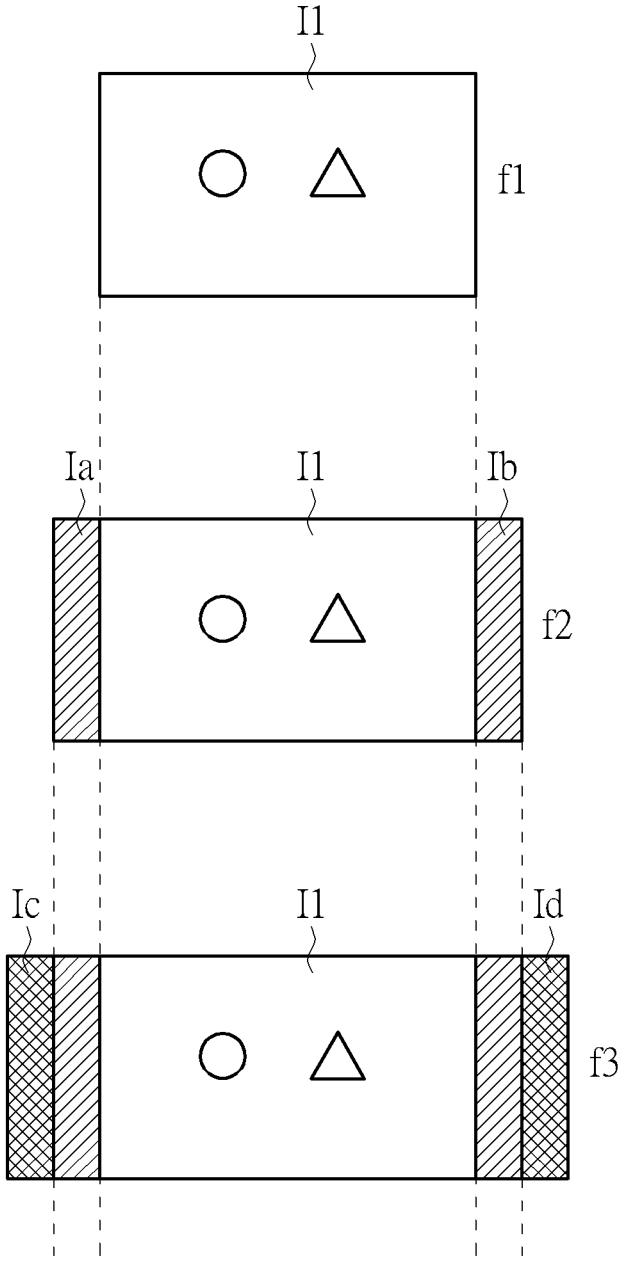
FIG. 3 and FIG. 4 are schematic diagrams illustrating an image processing method according to one embodiment of the present invention.
Figure 4:
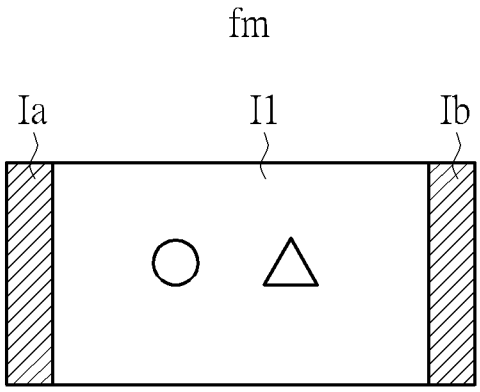

FIG. 3 and FIG. 4 are schematic diagrams illustrating an image processing method according to one embodiment of the present invention. Please note, the embodiments in FIG. 3 and FIG. 4 correspond the movement in FIG. 1A, thus please simultaneously refer to FIG. 1A, FIG. 3 and FIG. 4 to under the present invention for more clear. FIG. 3 is a schematic diagram illustrating that the auto clean apparatus R respectively capture images f1, f2 and f3 at different locations P1, P2, P3. Also, the light source in the auto clean apparatus R operates in a first mode while capturing images f1, f3, and the light source in the auto clean apparatus R operates in a second mode while capturing the images f2. In one embodiment, the light source does not emit light to the target object W in the first mode, but emits light in the second mode. In another embodiment, the light source emits light to the target object W in the first mode, but does not emit light in the second mode.

As illustrated in FIG. 3, comparing with the image f2, the image f1 also comprises the content of the image region I1, but does not comprise the contents for image regions Ia and Ib. Also, comparing with the image f2, the image f3 comprises contents for image regions I1, Ia and Ib, but further comprises the contents for image regions Ic and Id. Accordingly, a wrong target image after background noise removing will be acquired if a subtracting operation is performed to the images f2, f1, or performed to images f3, f1.

Therefore, the present invention firstly combines the images f1, f3 to acquire a combined image, and subtracting the combined image from the image f2 to acquire the target image after background noise removing. FIG. 4 is an exemplary embodiment for a combined image fm. In this embodiment, the combined image fm comprises contents for the image region I1 of the image f1, and comprises contents for image regions Ia, Ib of the image f3. That is, the combined image fm comprises all contents of the image f1 and only part of contents of the image f3. Also, a size of the image f2 equals to a size of the combined image fm. A corresponding location relation between the image f2 and the target object W is the same as the corresponding location relation between the combined image fm and the target object. The differences between the images f2, f1, and differences between the images f2, f3 have different directions. For example, the differences between the images f2, f1 are negative, and the differences between the images f2, f3 are positive. Accordingly, if part of contents of the image f3 are replaced with the contents of the image f1, the differences can be counterbalanced. By this way, a more accurate target image after background noise removing can be acquired. However, please note the embodiment depicted in FIG. 4 is only an example, related variation based on the teaching and disclosure for the embodiment of FIG. 4 should fall in the scope of the present invention.

Figure 5:
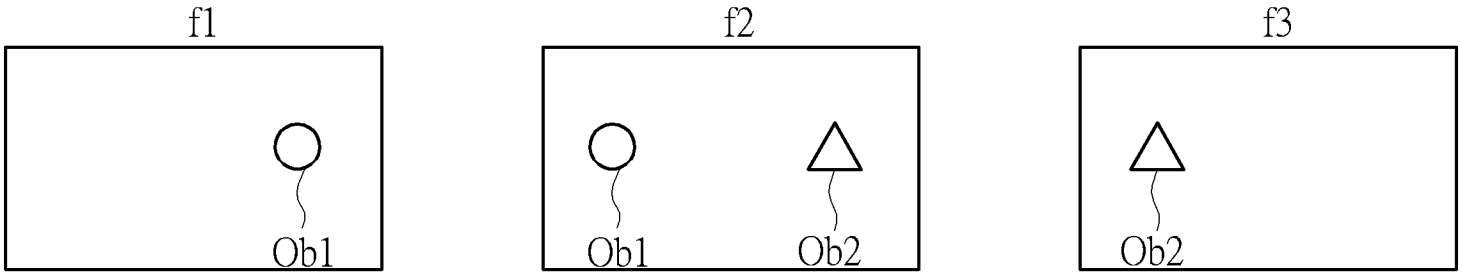
FIG. 5 and FIG. 6 are schematic diagrams illustrating an image processing method according to another embodiment of the present invention.
Figure 6:
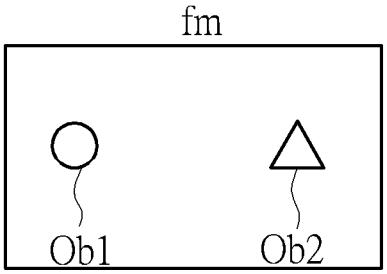

FIG. 5 and FIG. 6 are schematic diagrams illustrating an image processing method according to another embodiment of the present invention. The embodiments depicted in FIG. 5 and FIG. 6 correspond the movement in FIG. 2A of the present invention, and can correspond an example that the auto clean apparatus R rotates. FIG. 5 is a schematic diagram illustrating that the auto clean apparatus R respectively capture images f1, f2 and f3 at different locations P1, P2, P3. Also, the light source in the auto clean apparatus R operates in a first mode while capturing images f1, f3, and the light source in the auto clean apparatus R operates in a second mode while capturing the images f2. In one embodiment, the light source does not emit light to the target object W in the first mode, but emits light in the second mode. In another embodiment, the light source emits light to the target object W in the first mode, but does not emit light in the second mode.

As shown in FIG. 5, images f1, f2 and f3 comprise different contents since the auto clean apparatus R moves. For more detail, the image f1 only comprises the object ob1, the image f2 comprises objects ob1 and ob2, and the image f3 only comprises the object ob2. Accordingly, a wrong target image after background noise removing will be acquired if a subtracting operation is performed to the images f2, f1, or performed to images f3, f1. Therefore, a part of the image f1 and a part of the image f3 are combined to generate a combined image. As illustrated in FIG. 6, the combined image fm comprises a right half part of the image f1 and a left half part of the image f3, thereby the combined image fm comprises objects ob1 and ob2. Therefore, if the combined image fm is subtracted from the image f2, a more accurate target image after background noise removing can be acquired. Which part of the images f1, f3 should be selected to generate the combined image is related with the moving direction of the auto clean apparatus R. Accordingly, in one embodiment, parts of the images f1, f3 are selected to generate the combined image based on the moving direction of the auto clean apparatus R.

Figure 1A:
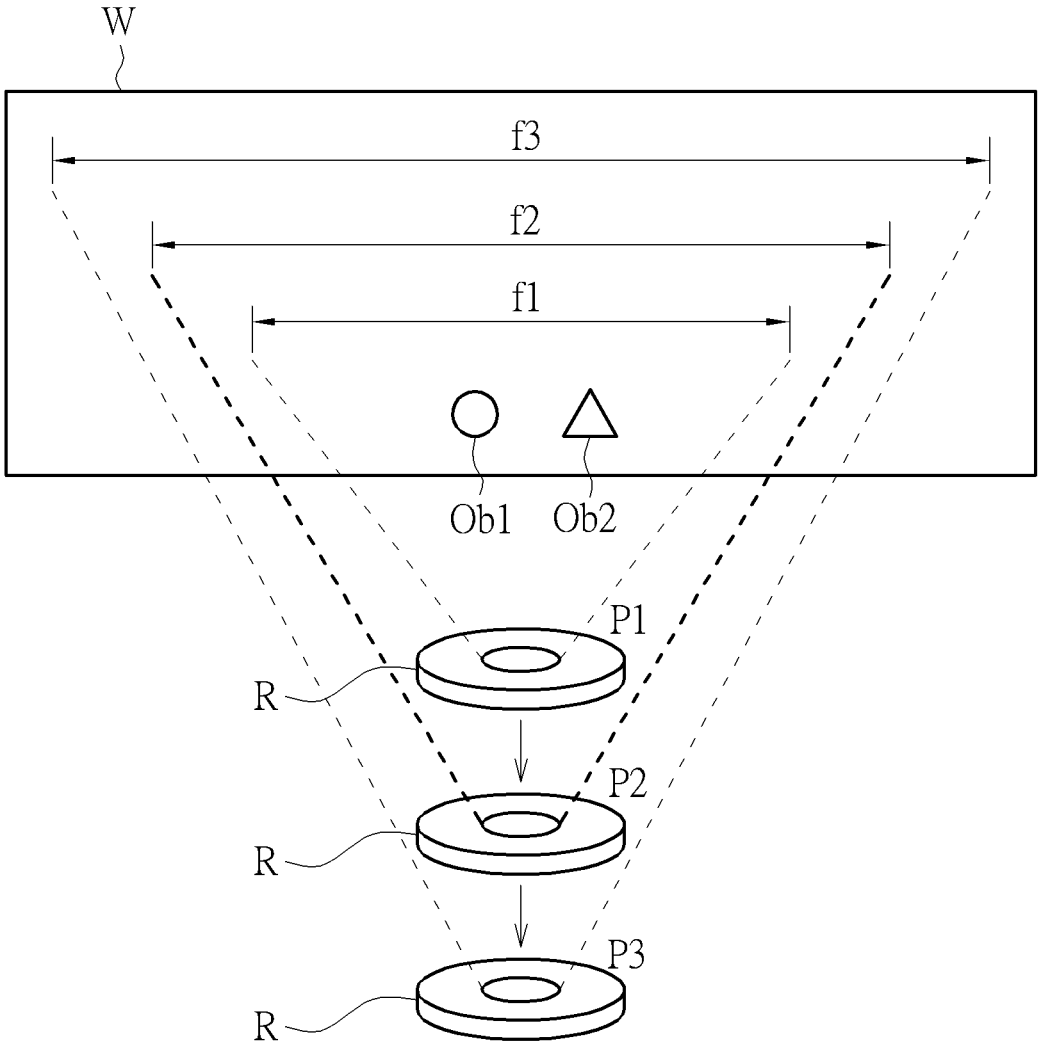
FIG. 1A PRIOR ART
FIG. 1A is a schematic diagram illustrating that an auto clean apparatus gradually moves away from a target object.
Figure 1B:
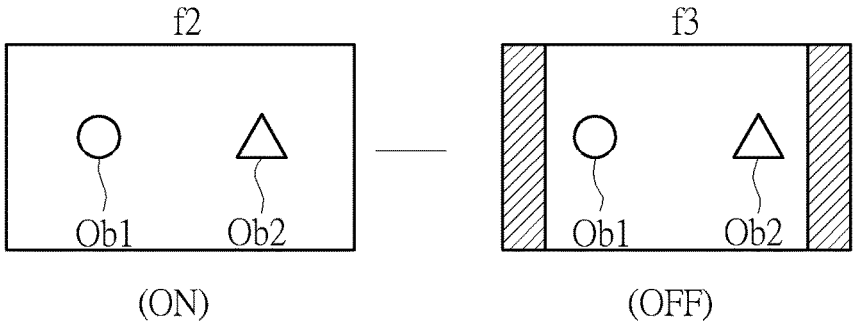
FIG. 1B PRIOR ART
FIG. 1B is a schematic diagram illustrating how to acquire a target image after background noise removing in the example depicted in FIG. 1A.
Figure 2A:
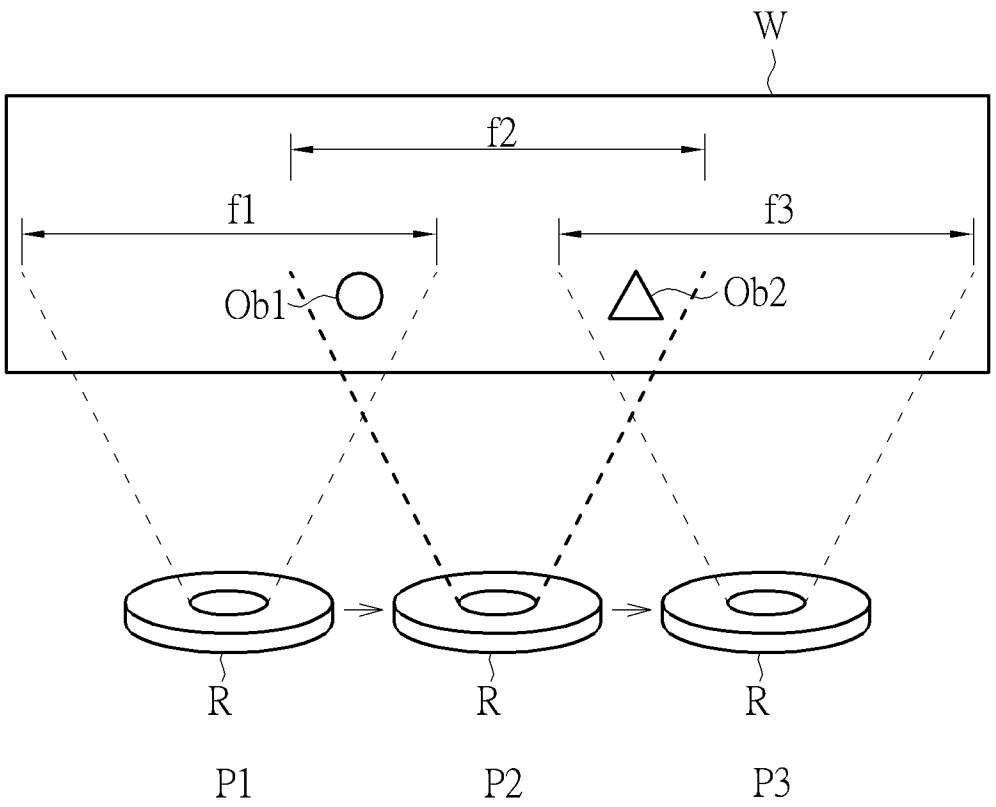
FIG. 2A PRIOR ART
FIG. 2A is a schematic diagram illustrating a conventional auto clean apparatus moves relative to the target object.
Figure 2B:
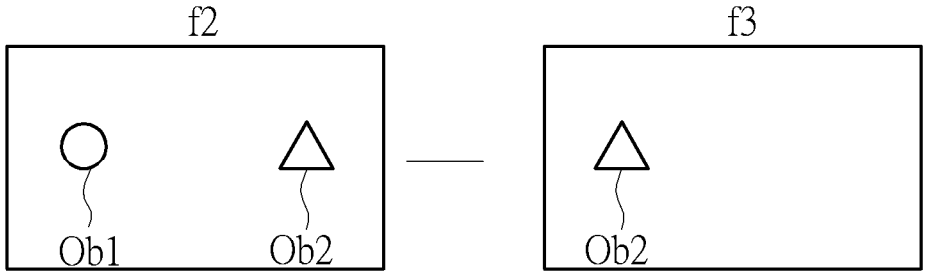
FIG. 2B PRIOR ART
FIG. 2B is a schematic diagram illustrating how to acquire a target image after background noise removing in the example depicted in FIG. 2A.

In one embodiment, the above-mentioned steps for generating images f1, f2, f3, the step of generating a combined image, and the step of acquiring the target image after background noise removing maybe performed in following situations: the auto clean apparatus R is moving, the auto clean apparatus R is moving as illustrated in FIG. 1A, FIG. 2A, a distance between the auto clean apparatus R and the target object changes, or the auto clean apparatus R is rotating. That is, the auto clean apparatus R does not generate a combined image when it stops, thereby the power consumption can be saved.

Figure 7:
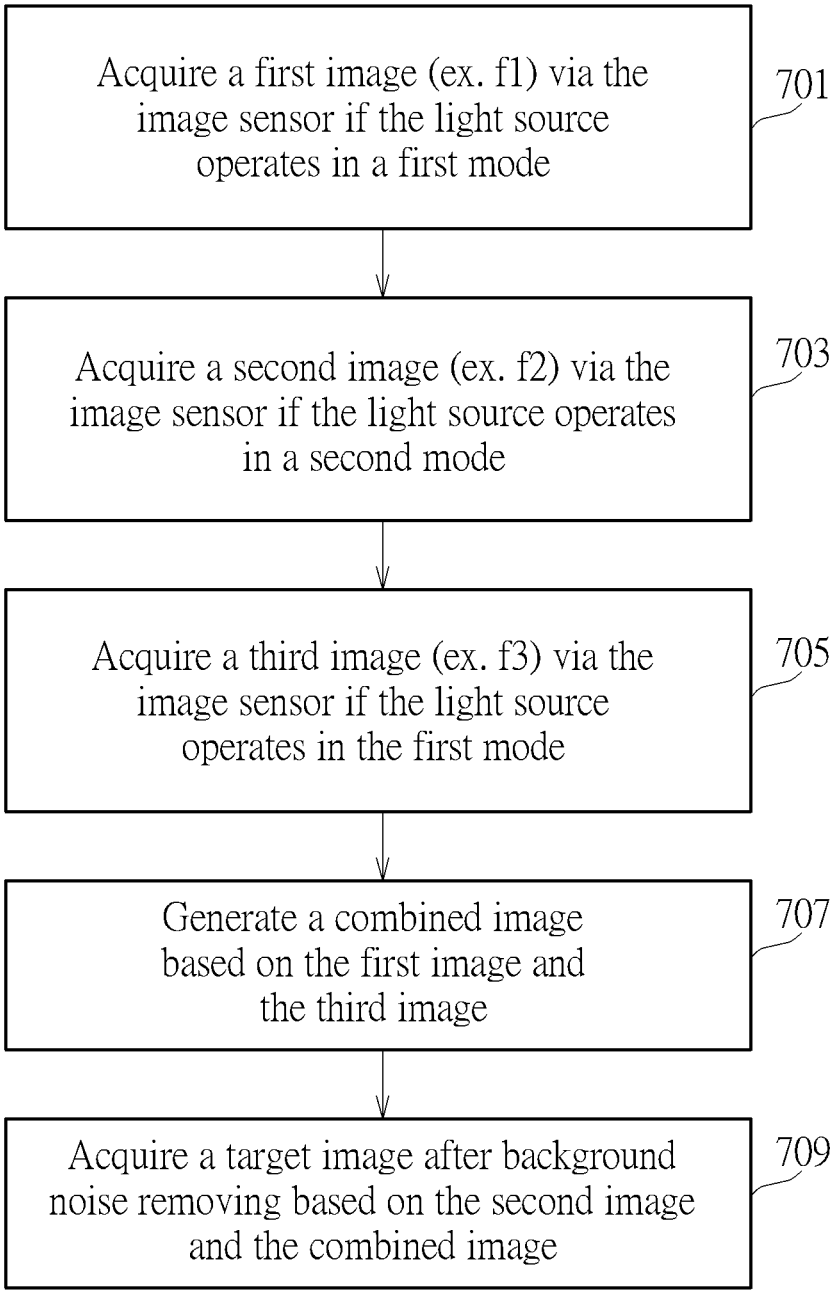
FIG. 7 is a flow chart illustrating an image processing method according to one embodiment of the present invention.

Please note, the target image after background noise removing acquired by above-mentioned embodiments is not limited to be applied for measuring distance, but also can be applied for other purposes. Besides, such method is not limited to be applied to three continuous images. Thus, in view of above-mentioned embodiments, an image processing method applied to an image processing apparatus comprising a light source and an image sensor can be acquired. The image sensing method comprises steps illustrated in FIG. 7:

Step 701

Acquire a first image (ex. f1) via the image sensor if the light source operates in a first mode. In one embodiment, the first image comprises at least part for an image of a target object (ex. a wall).

Step 703

Acquire a second image (ex. f2) via the image sensor if the light source operates in a second mode. In one embodiment, the second image comprises at least part for an image of the target object.

Step 705

Acquire a third image (ex. f3) via the image sensor if the light source operates in the first mode. In one embodiment, the third image comprises at least part for an image of the target object.

Step 707

Generate a combined image based on the first image and the third image.

Step 709

Acquire a target image after background noise removing based on the second image and the combined image.

Please note, the step of acquiring a target image after background noise removing is not limited to "subtracting".

Figure 8:
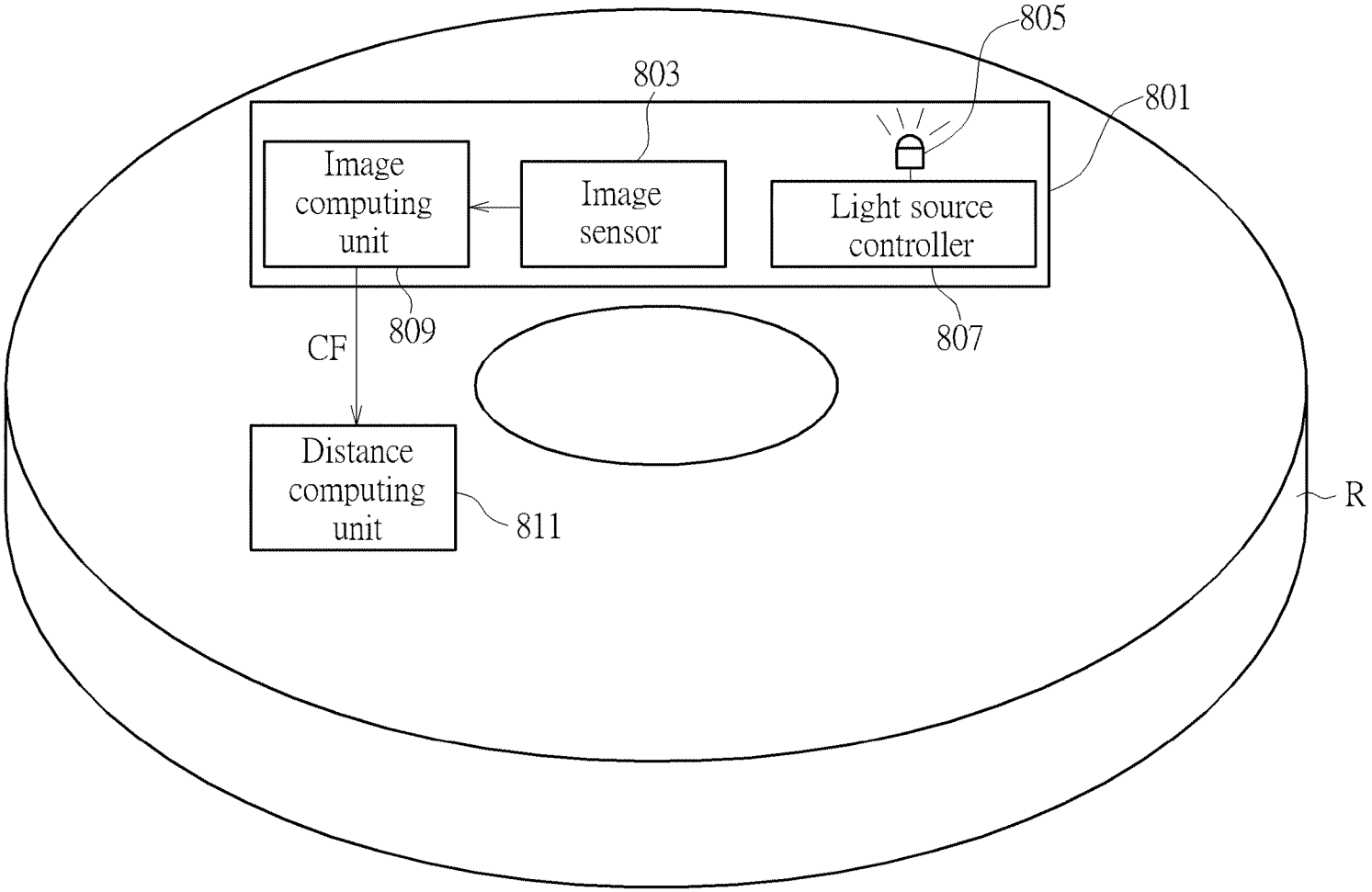
FIG. 8 is a block diagram illustrating an image processing apparatus according to one embodiment of the present invention.

FIG. 8 is a block diagram illustrating an image processing apparatus according to one embodiment of the present invention. In this embodiment, the image processing apparatus 801 is provide in the auto clean apparatus R, but not limited. As illustrated in FIG. 8, the image processing apparatus 801 comprises an image sensor 803, a light source 805, a light source controller 807 and an image computing unit 809. The light source 805 is controlled by the light source controller 807 to emit light or not to emit light. The image sensor 803 is configured to respectively capture images while the light source 805 operates in different modes. The image computing unit 809 is configured to compute a target image after background noise removing according to images captured by the image sensor 803 as above-mentioned. Also, the image computing unit 809 calibrates the target image after background noise removing and transmits a calibrated image CF to the distance computing circuit unit 811. Please note, the target image after background noise removing can be directly applied as the calibrated image CF. The distance computing unit 811 calibrates a distance between the auto clean apparatus R and the target object according to a plurality of calibrated images CF. The distance computing unit 811 can be provided in the image processing apparatus 801 as well. Please note, the embodiment in FIG. 8 is only for example and does not mean to limit the scope of the present invention. The devices depicted in the embodiment of FIG. 8 can be combined or be separated.

In view of above-mentioned embodiments, the image processing method provided by the present invention can avoid the problem that a wrong target image after background noise removing is acquired due to the movement of the auto clean apparatus R, thereby a correct distance can be computed.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image processing method, applied to an image processing apparatus comprising a light source and an image sensor, wherein the image sensing method comprises:

acquiring a first image via the image sensor when the light source does not emit light;

acquiring a second image via the image sensor when the light source emits light;

acquiring a third image via the image sensor when the light source operates does not emit light;

generating a combined image based on only part of contents of the first image and only part of contents of the third image, but not based on the second image; and acquiring a target image after background noise removing via subtracting the combined image from second image.

2. The image processing method of claim 1, wherein the second image is captured after the first image is captured, and the third image is captured after the second image is captured.

3. The image processing method of claim 1, further comprising:

computing a distance between an electronic apparatus to be determined and a target object according to the target image after background noise removing.

4. The image processing method of claim 3, wherein the first image, the second image, the third image, the combined image and the target image after background noise removing are generated while the electronic apparatus to be determined is moving.

5. The image processing method of claim 4, wherein the first image, the second image, the third image, the combined image and the target image after background noise removing are generated while a distance between the electronic apparatus and the target object is changing.

6. The image processing method of claim 4, wherein the first image, the second image, the third image, the combined image and the target image after background noise removing are generated while the electronic apparatus to be determined is moving relative with the target object.

7. The image processing method of claim 4, wherein the first image, the second image, the third image, the combined image and the target image after background noise removing are generated while the electronic apparatus to be determined is rotating.

8. The image processing method of claim 1, wherein a size of the second image equals to a size of the combined image, wherein a corresponding location relation between the second image and a target object is the same as a corresponding location relation between the combined image and the target object.

9. The image processing method of claim 1, wherein the step of generating a combined image based on the first image and the third image generates the combined image according to a moving direction of the electronic apparatus to be determined.

10. The image processing method of claim 1, wherein the combined image comprises content for a right half part of the first image and a left half part of the third image.

11. The distance measuring apparatus of claim 1, wherein the first image, the second image and the third image comprise different contents, wherein the contents are not brightness.

12. An distance measuring apparatus, comprising:

a light source;

an image sensor, configured to acquire a first image when the light source operates does not emit light, to acquire a second image when the light source emits light and to acquire a third image when the light source does not emit light;

wherein the distance measuring apparatus generates a combined image based on only part of contents of the first image and only part of contents of the third image but not based on the second image, and to acquire a target image after background noise removing via subtracting the combined image from second image;

wherein the distance measuring apparatus computes a distance between an electronic apparatus to be determined and a target object according to the target image after background noise removing.

13. The distance measuring apparatus of claim 12, wherein the second image is captured after the first image is captured, and the third image is captured after the second image is captured.

14. The distance measuring apparatus of claim 12, wherein a size of the second image equals to a size of the combined image, wherein a corresponding location relation between the second image and a target object is the same as a corresponding location relation between the combined image and the target object.

15. The distance measuring apparatus of claim 12, wherein the first image, the second image and the third image comprises different content, wherein the contents are not brightness.

16. The distance measuring apparatus of claim 12, wherein the distance measuring apparatus generates the combined image based on the first image and the third image and according to a moving direction of the electronic apparatus to be determined, wherein the combined image comprises content for a right half part of the first image and a left half part of the third image.

* * * * *